US010306986B1

(12) United States Patent
Gu et al.

(10) Patent No.: US 10,306,986 B1
(45) Date of Patent: Jun. 4, 2019

(54) MOTORIZED FURNITURE HEADREST ASSEMBLY FOR SEATING SYSTEMS

(71) Applicant: ZHEJIANG FEILI TECHNOLOGY CO., LTD., Zhejiang (CN)

(72) Inventors: Weijie Gu, Zhejiang (CN); Guoli Zou, Zhejiang (CN); Wangliang Zhang, Zhejiang (CN)

(73) Assignee: ZHEJIANG FEILI TECHNOLOGY CO., LTD., Zhejiang (CN)

( * ) Notice: Subject to any disclaimer, the term of this patent is extended or adjusted under 35 U.S.C. 154(b) by 58 days.

(21) Appl. No.: 15/579,490

(22) PCT Filed: May 25, 2017

(86) PCT No.: PCT/CN2017/085987

§ 371 (c)(1),
(2) Date: Dec. 4, 2017

(87) PCT Pub. No.: WO2018/214118

PCT Pub. Date: Nov. 29, 2018

(51) Int. Cl.

| | |
|---|---|
| ***A47C 1/024*** | (2006.01) |
| ***A47C 7/46*** | (2006.01) |
| ***A47C 1/032*** | (2006.01) |
| ***A47C 7/38*** | (2006.01) |

(52) U.S. Cl.
CPC ..... *A47C 1/0242* (2013.01); *A47C 7/38* (2013.01); *A47C 7/462* (2013.01)

(58) Field of Classification Search
CPC ..... A47C 7/38; A47C 1/0242; A47C 7/462; A47C 17/04
See application file for complete search history.

(56) References Cited

U.S. PATENT DOCUMENTS

| | | | | |
|---|---|---|---|---|
| 6,193,313 | B1 * | 2/2001 | Jonsson | A47C 1/023 297/284.1 |
| 8,608,240 | B2 | 12/2013 | Marshall et al. | |
| 8,702,173 | B2 | 4/2014 | Adams et al. | |
| 9,730,522 | B2 | 8/2017 | Donovan | |
| 10,085,562 | B1 * | 10/2018 | Labrosse | A47B 9/00 |

(Continued)

FOREIGN PATENT DOCUMENTS

| | | |
|---|---|---|
| CN | 201227042 Y | 4/2009 |
| CN | 201286506 Y | 8/2009 |

(Continued)

OTHER PUBLICATIONS

International Search Report and a Written Opinion of the International Searching Authority for Application No. PCT/CN2017/085987, dated Nov. 16, 2017.

*Primary Examiner* — Shin H Kim
(74) *Attorney, Agent, or Firm* — Marshall, Gerstein & Borun LLP

(57) ABSTRACT

A motorized furniture headrest assembly includes a headrest actuator and roller track that minimizes effort of a motor to impart angular movement of an associated headrest support mechanism. The roller track is curvilinear with a non-constant radius of curvature. The actuator and roller track are disposed sufficiently close to a center line of the headrest support mechanism to achieve angular actuation of the headrest support mechanism without one side of the headrest support mechanism lagging behind the other during angular movement.

11 Claims, 16 Drawing Sheets

(56) References Cited

U.S. PATENT DOCUMENTS

| | | | | |
|---|---|---|---|---|
| 2002/0014795 | A1* | 2/2002 | Williams | A47C 1/023 297/337 |
| 2005/0264051 | A1* | 12/2005 | Lawall | B60N 2/42781 297/216.12 |
| 2006/0055214 | A1* | 3/2006 | Serber | B60N 2/0745 297/216.1 |
| 2007/0001499 | A1* | 1/2007 | Smith | A47C 1/022 297/362.13 |
| 2007/0106188 | A1 | 5/2007 | Walker | |
| 2011/0227378 | A1* | 9/2011 | Swierczewski | B60N 2/06 297/216.15 |
| 2014/0239677 | A1* | 8/2014 | Laib | B60N 2/5642 297/180.1 |
| 2016/0361216 | A1 | 12/2016 | Liu et al. | |
| 2017/0360201 | A1 | 12/2017 | Brown | |
| 2018/0360218 | A1* | 12/2018 | Labrosse | G05B 19/402 |

FOREIGN PATENT DOCUMENTS

| | | | |
|---|---|---|---|
| CN | 201286507 | Y | 8/2009 |
| CN | 103007375 | A | 4/2013 |
| CN | 106419272 | A | 2/2017 |
| EP | 1382320 | A1 | 1/2004 |
| TW | 521951 | U | 2/2003 |
| WO | WO-2017006928 | A1 | 1/2017 |

* cited by examiner

MOTORIZED FURNITURE HEADREST ASSEMBLY FOR SEATING SYSTEMS

CROSS-REFERENCE TO RELATED APPLICATION

The present application is the US national phase of International Application No. PCT/CN2017/085987, filed May 25, 2017. The entirety of PCT/CN2017/085987 is hereby incorporated by reference.

BACKGROUND

Field of the Disclosure

This application relates generally to adjustable furniture and, more specifically, to motorized adjustment of headrests and lumbar features of seating systems.

Description of the Related Art

Recliner seating systems frequently include features to enhance the comfort of the user. For example, a seating system may include an actuatable headrest, foot rest, back deck, and/or lumbar feature. While various attempts have been made to produce motorized actuatable features in such seating systems, a drawback of many such systems is that the actuator mechanism is required to perform too much work to effect the desired adjustment of the actuatable feature. For instance, a movable headrest may have its actuation controlled by a linear actuator mounted to a side support strut of a headrest sub-assembly in the frame of a reclining seat. This linear actuator features a cam roller that is constrained within a curvilinear cam track having a fixed radius of curvature.

By mounting the linear actuator to the side support strut, in recliner seats having relatively wide headrests, it is found that the motion of the headrest imparted by the cooperation of the cam roller and curvilinear cam track tends to be uneven. That is, while the side of the headrest closest to the actuator undergoes desired angular motion according to the travel of the cam roller and curvilinear cam track profile, the side of the headrest farthest away from the actuator lags behind. This can, at a minimum, create an undesirable uneven appearance of the headrest when in an extended condition. At worst, this uneven motion of the headrest can lead to jamming of the hardware used to achieve the actuation of the headrest.

Another drawback of conventional motorized actuatable headrest systems is the amount of force and extent of travel the linear actuator has to exert in order to effect a desired movement of the headrest.

It would be desirable for an actuatable headrest system to employ a single actuator mounted in a manner that avoids the tendency for one side of the headrest to lag behind the other when undergoing angular movement. It would also be desirable for such a system to employ a design that minimizes the extent of travel and amount of energy that must be exerted by the linear actuator to effect the desired angular movement of the headrest. The manner in which these and other objects of the present disclosure are achieved will become evident with reference to the following summary of the disclosure, the drawings, and the detailed description of the preferred embodiments.

SUMMARY OF THE DISCLOSURE

An actuatable headrest and an actuatable lumbar support are provided in a headrest and lumbar support module of the present disclosure. This headrest and lumbar support module can be provided as a single unit that a reclining seat manufacture can readily install into a frame of a back deck of a reclining seat. By spacing actuator members of the headrest and lumbar support module inwardly from the side supports of the frame of the back deck, the actuator members need not be secured directly to the frame of the back deck.

Actuation of the headrest is accomplished by a motorized linear actuator member pivotally mounted at a first end and having a wheel unit disposed at a second end opposite the first end. The wheel unit includes a cam wheel that engages a cam surface of a cam track member, also referred to herein as a curvilinear track bracket, that is mounted to a cross-bar. The cross-bar defines a portion of a frame of the headrest.

The profile of the cam surface of the cam track has a non-constant radius of curvature. More specifically, the cam track is curvilinear, having at least a first portion which is straight and a second portion that is curved. As the cam wheel of the wheel unit of the motorized linear actuator member travels along the cam surface of the cam track member, the cam track member (i.e., the curvilinear track bracket), and thus the connected headrest frame, moves angularly. The profile of the cam surface of the cam track member permits the headrest to move angularly with less motion of the linear actuator member than conventional cam tracks having a curved shape of a single, constant radius of curvature.

Moreover, the cam track member does not form a cam track that encloses a cam roller. Rather, the cam surface, also referred to herein as a curvilinear track, is provided along an exposed edge of the curvilinear track bracket. This design permits the wheel unit to include cam wheel shrouds on both sides of the cam wheel, thereby preventing debris from interfering with smooth rolling motion of the cam wheel (also referred to herein as a roller wheel). The cam wheel shrouds also serve as bumpers to maintain contact between the roller wheel and the curvilinear track.

By mounting the headrest actuator and lumbar actuator toward the center of the headrest and lumbar support module, the headrest actuator is able to avoid imparting torsion to the headrest during actuation regardless of the width of the headrest.

DETAILED DESCRIPTION OF THE PREFERRED EMBODIMENT

In the following paragraphs, examples of various embodiments are described in detail and in doing so, reference will be made to a number of drawings in different figures.

Figure 1:
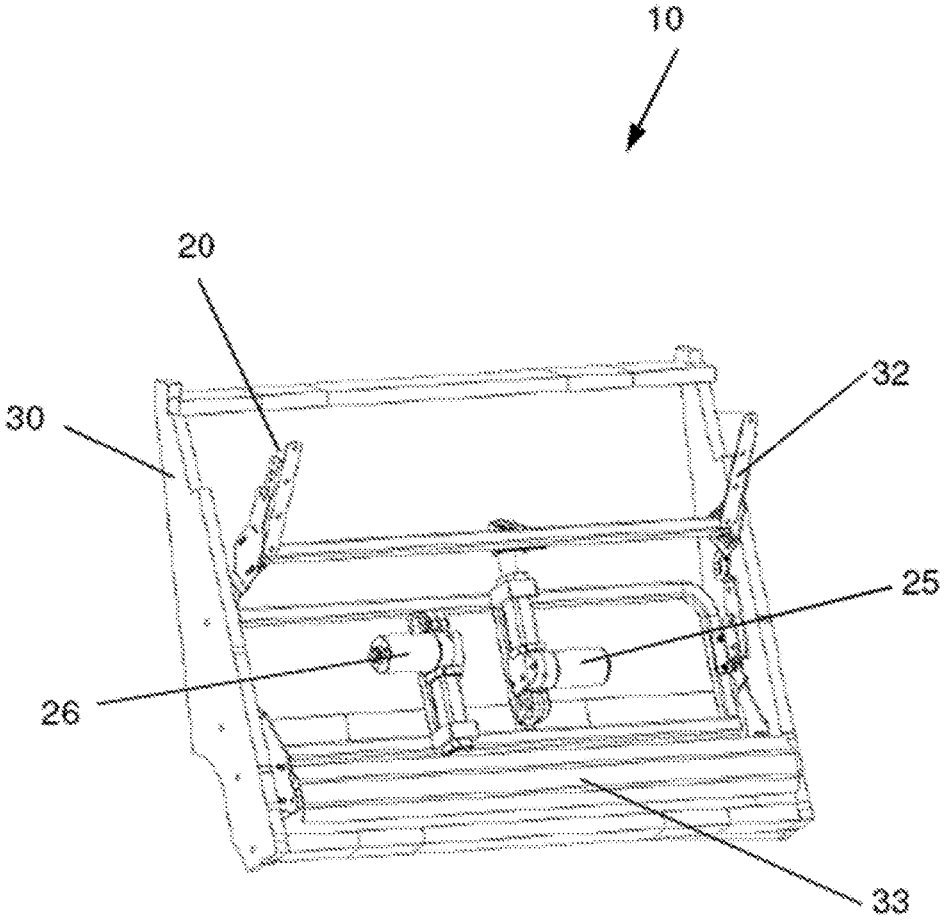
FIG. 1 is a front perspective view of a frame for a back deck of a reclining seat, including actuatable headrest and lumbar support mechanisms.

FIG. 1 shows a front perspective view of a frame for a back deck of a reclining seat, including actuatable headrest and lumbar support mechanisms. Depicted is a motorized headrest and lumbar actuation system 20 with a wooden frame 30, which combine to form an integrated wooden frame and motorized headrest and lumbar system 10. The motorized headrest and lumbar actuation system 20 is typically a metallic subassembly that is assembled independent of the wooden frame 30. These two main parts 20 and 30 are ultimately combined together, for example at the site of a reclining furniture manufacturer, to form the complete integrated wooden frame and motorized headrest and lumbar actuation system 10. The main components of the motorized headrest and lumbar actuation system 20 include a first actuation mechanism 25, which is used for moving the headrest and is also referred to as the headrest actuation mechanism 25. Also included is a second actuation mechanism, used to move the lumbar actuation mechanism 26, and also referred to as a lumbar actuation mechanism 26. Typically, these two actuation mechanisms are similar and possibly even identical. However the two actuation mechanisms are mounted parallel to each other and facing opposite directions from one another, as illustrated in FIG. 1. The first actuation mechanism 25 moves the headrest part of the seat through pushing against an upper, headrest cross bar member 51 and consequently moving a hingedly-mounted headrest support mechanism 32. The second actuation mechanism 26 moves a lumbar part of the seat through pushing against a lower, lumbar cross bar member 53 and consequently moving a lumbar support mechanism 33. These two actuation mechanisms can move independent of one another and can be controller independently as well, such as using a two-feature control device (not shown).

Figure 2:
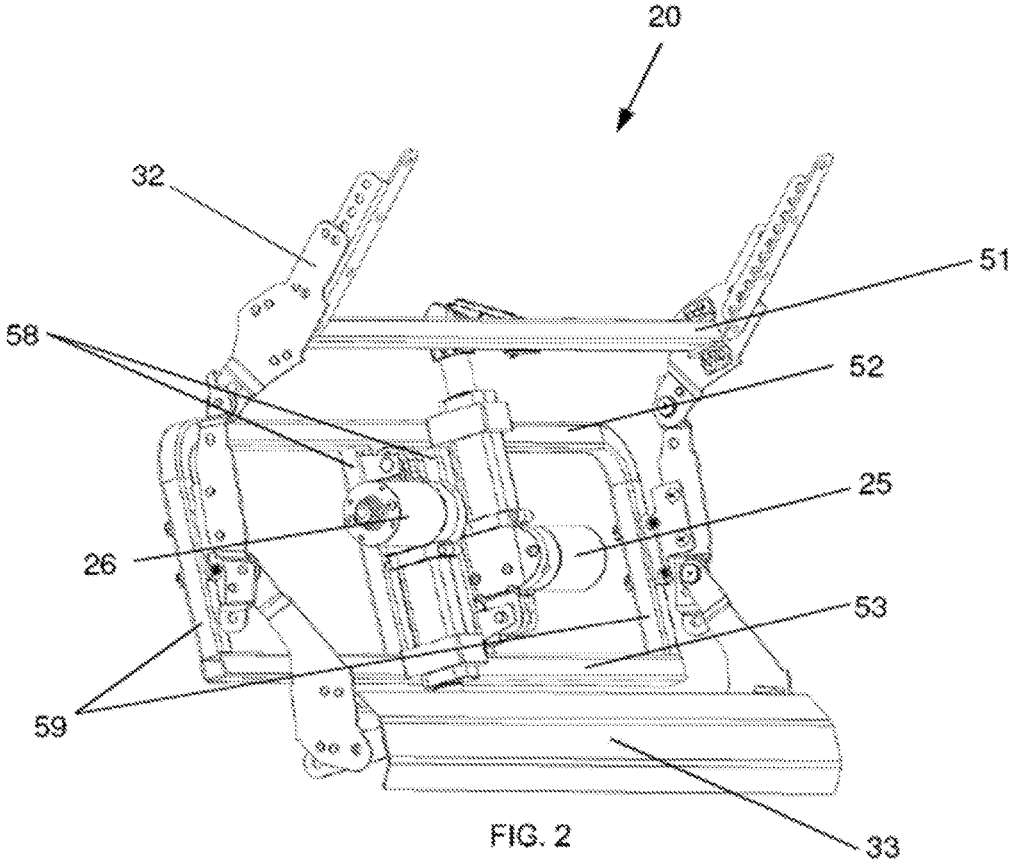
FIG. 2 is a front perspective view of a headrest and lumbar support module of the present disclosure that can be installed in a back deck frame.
Figure 3:
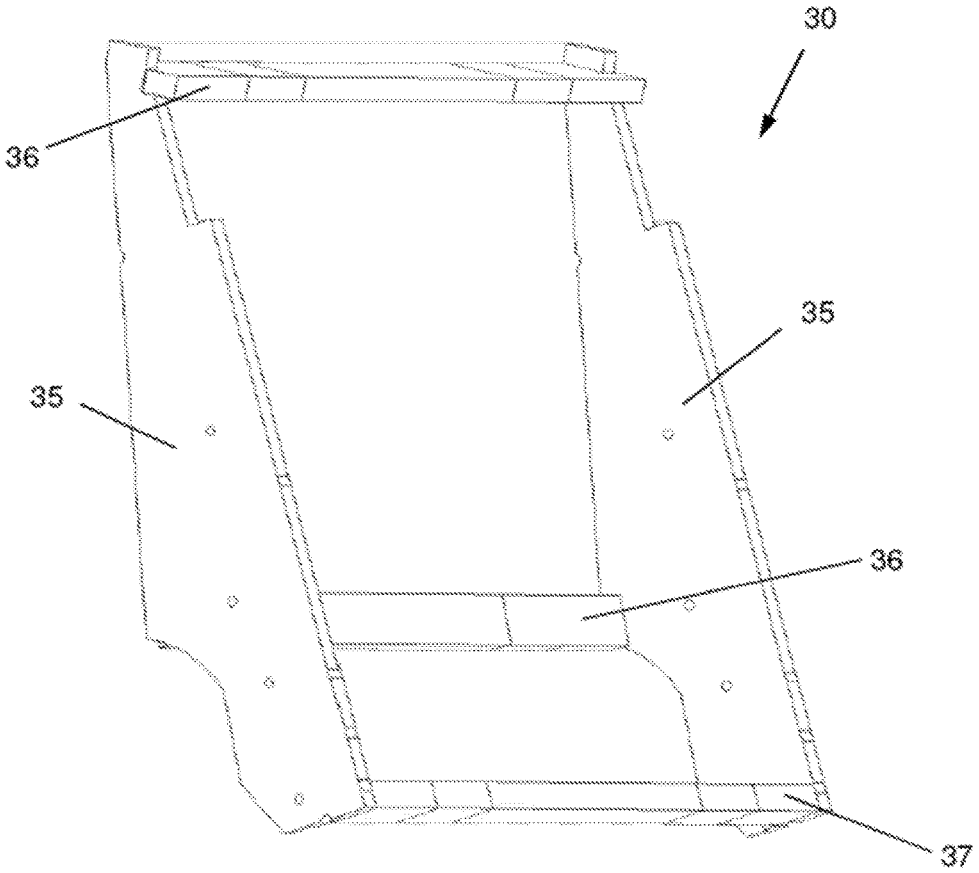
FIG. 3 is a front perspective view of the frame for a back deck of FIG. 1, prior to installation of the headrest and lumbar support module of FIG. 2.

The components of the integrated wooden frame and motorized headrest and lumbar actuation system 10 illustrated in FIG. 1 are shown separately, and prior to integration with each other, in FIGS. 2 and 3.

FIG. 2 illustrates a front perspective view of a headrest and lumbar support module of the present disclosure prior to installation in a back deck frame. This headrest and lumbar support module is also referred to herein as the motorized headrest and lumbar actuation system 20. It is an independently manufactured subassembly that is typically made from metallic bars that are welded together or alternatively connected to each other using nuts and bolts. It is also possible that both welding and bolting methods are used in combination with each other to fabricate this subassembly. The metallic components are usually coated with paint or other type of protective resin in order to minimize the effects of corrosion or wear and tear and consequently make it possible to extend the usable life of the product.

As illustrated in FIG. 2, there are two motorized actuation mechanisms 25 and 26 included in the motorized headrest and lumbar actuation mechanism 20. As mentioned above, these two motorized actuation mechanisms 25 and 26 are independent of one another and their motion and control can be controlled independently. Alternatively, and if so desired, it is possible to synchronize the motion of these two independent motorized actuation mechanism using appropriate electronics and/or software applications, such that headrest and lumbar motion occurs simultaneously. The two motorized actuation mechanisms are mounted parallel to each other but their direction of motion is diametrically opposed from one another. The first motorized actuation mechanism 25 pushes upward against the headrest cross bar member 51 in order to move the headrest support mechanism 32, while the second motorized actuation mechanism 26 pushes downward against the lumbar cross bar member 54 in order to move the lumbar support mechanism 33.

It is desirable for an actuatable headrest system to employ a single actuator mounted in a manner that avoids the tendency for one side of the headrest to lag behind the other side when undergoing angular movement, such as tends to be the case with relatively wide adjustable headrests. Similarly, it is desirable for an actuatable lumbar system to employ a single actuator mounted in a manner that avoids the tendency for one side of the lumbar to lag behind the other when undergoing angular movement, such as with relatively wide lumbar supports. For this reason, it is desirable to mount the motorized actuator mechanisms 25 and 26 as close to the middle section of the actuation system as possible. Since in this motorized system there exist two separate actuator mechanisms, they are placed closed to each other near the middle point of the actuation system, but neither along a central axis, so as to have as advantageous an actuator placement as possible for both headrest and lumbar actuators, rather than a most-advantageous dead-center location for one, which would require a farther-off-center location for the other, although such an arrangement is still possible and is considered within the scope of the present disclosure, if the manufacturer desired such a compromise.

The two actuator mechanisms 25 and 26 are mounted on two separate, axially extending middle cross bar members 58 which are connected at one end to the upper cross bar member 52 and on the other end to the lower cross bar member 53. The two middle cross bar members 58 are of the same length but are relatively shorter than the upper cross bar member 52 and the lower cross member 53 the two of which are approximately the same length. The two middle cross bar members 58 are connected to the upper cross bar member 52 and the lower cross bar member 53 in a perpendicular fashion.

Also connected in a perpendicular fashion to the upper cross bar member 52 and the lower cross bar member 53 are the two side cross bar members 59. These metallic bar shaped members 52, 53, 58, and 59 are attached to each other in a firm and secure fashion, either through being welded together, bolted together, or other suitable attachment techniques, or any combination thereof. The bar shaped members 52, 53, 58, and 59 are integral components that form a core rectangular shaped bracket, onto which the other metallic components of the motorized headrest and lumbar actuator system 20, including the two actuation mechanisms 25 and 26, are attached.

FIG. 3 is a front perspective view of the frame for a back deck wooden frame 30 of FIG. 1. This wooden frame 30 is illustrated in FIG. 3 by itself, prior to installation of the headrest and lumbar support module of FIG. 2, i.e., the motorized headrest and lumbar actuation system 20. This wooden frame 30 includes several parts that are typically attached together using such mechanisms as screws, nails, glue, dove tails, or other similar wood-working connections or techniques frequently used in furniture frame manufacture. It is possible that a combination of connections and techniques are used. The components include two side members of the wooden seatback frame 35, the upper cross member of the wooden seat back frame 36, the backside cross member of the wooden seat back frame 36, and the lower cross member of the wooden seatback frame 37. Together, the components 35, 36, and 37 form a box-like wooden frame that support a back side, or back deck, of the seat. As mentioned above, this wooden frame 30 is typically fabricated independent of the metallic motorized headrest and lumbar actuation system 20. The two modular subassembly components 20 and 30 are each designed, formed, and fabricated as independent and separate subassembly modules and then are assembled together at a later stage of the manufacturing process in order to form the motorized headrest and lumbar actuation system integrated with the wooden frame 10 that is illustrated in FIG. 1.

This manufacturing method of separately fabricating independent separate modular subassemblies and then integrating them together at a later stage of the manufacturing process has a number of manufacturing advantages. In this fashion it is possible to subcontract for manufacturing the different parts of the final product, which in this case is the furniture seat, to different fabricators each with their particular skill set and are of expertise. In the example described in this disclosure, the wooden part 30 can be fabricated at one location by one manufacturer and the motorized headrest and lumbar actuation system 20 can be fabricated at another location by a different manufacturer. The final assembly to form the integrated wooden frame and motorized headrest and lumbar system 10 can be performed yet at third different place by a third group, or, more preferably, a supply of motorized headrest and lumbar actuation systems 20 can be delivered on a periodic basis to a location of the furniture manufacturer for integration as complementary wooden parts 30 are assembled to form reclining chairs. In this fashion it is possible to optimize production yield and time of production in addition to reducing inventory and minimizing the cost of manufacturing, which impacts the overall financial profitability of the product. It is also possible in this fashion to rapidly expand the production capacity of the manufacturing plant through outsourcing of the various components of the final product to various manufacturers or even outsourcing of the same component to a number of different manufacturers who could be competing against each other to minimize the production cost of the product. Repair or replacement of motorized headrest and lumbar actuation systems 20 is also facilitated by having the systems constructed as replaceable modules that are selectively securable to, and removable from, wooden frames 30.

Figure 4:
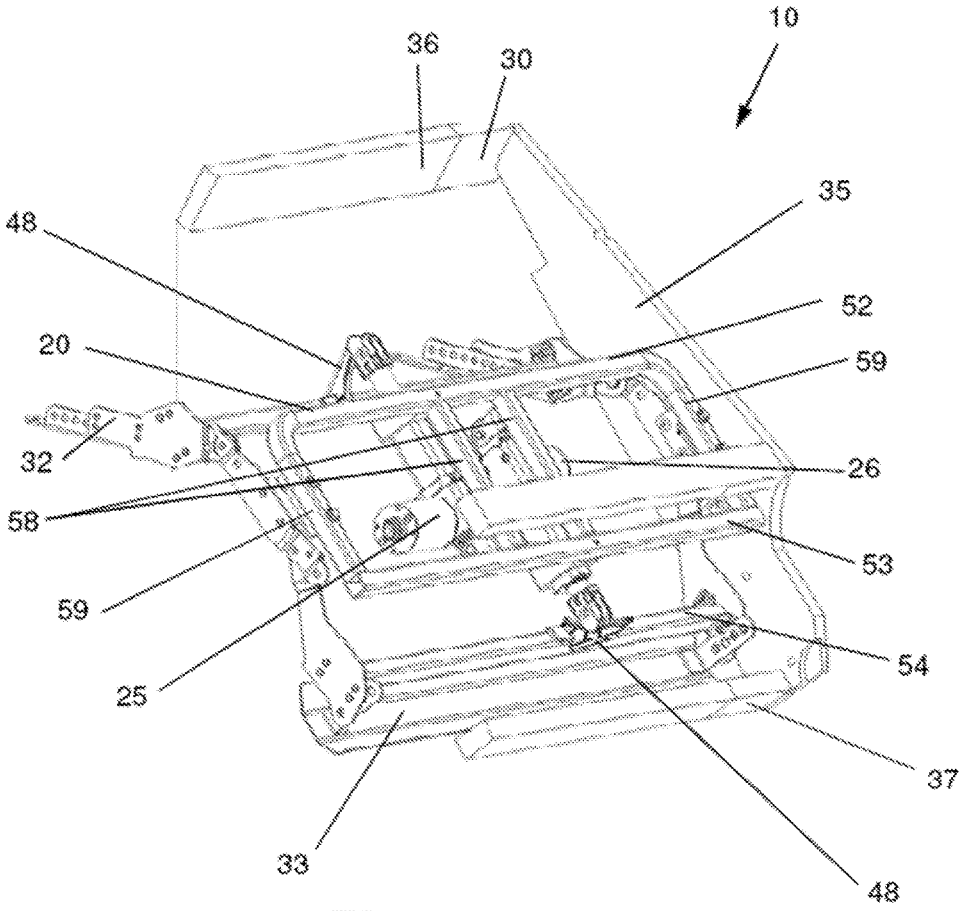
FIG. 4 is a bottom and rear perspective view, with the frame of the back deck of the reclining seat partially broken away, of the headrest and lumbar support module.

FIG. 4 illustrates the motorized headrest and lumbar actuation system 20 integrated with wooden frame 10. But unlike FIG. 1 that illustrates this same major component of the product in a front view perspective, the FIG. 4 shows it in a back view perspective. In FIG. 4 it is also indicated that a portion of the wooden frame is cut away, which is done for the sake of illustration only. The headrest support mechanism 32 is fully extended and can be seen in its angle of maximum displacement. The first actuation mechanism 25, which is the headrest actuation mechanism, is shown in its fully extended position and at its maximum range of travel. The tip of this actuation mechanism, which is a roller wheel 45, can be seen engaging a cam track member provided on the headrest cross bar member 51, which cross bar member is a portion of the headrest support mechanism 32. The engagement occurs along a special curvilinear track bracket 48 which will be described in greater detail below. There are two of these special curvilinear track brackets 48. One of these two brackets 48 is connected to the tip of the first actuation mechanism 25 and the other is connected to the tip of the second actuation mechanism 26.

Also illustrated in FIG. 4 is the back view of the second actuation mechanism 26, which is the lumbar actuation mechanism that is used to push against the lumbar cross bar member 54 and as a result extending the lumbar support mechanism 33. In FIG. 4, the actuation mechanism 26 is extended only partially, and is shown positioned approximately at its mid-point of its travel range. The lumbar support mechanism 33 is extended partially and is shown positioned approximately at the mid-point of the range of its angular travel. Also visible is the second special curvilinear track bracket 48, which is used to connect the tip of the second actuation mechanism 26 to the lumbar cross bar member.

Also visible in FIG. 4 are the upper cross bar member 52, the lower cross bar member 53, and the two side cross bar members 59. These metallic bar members 52, 53, 58, and 59 that are attached to each other in a firm and secure fashion either through being welded together, bolted together, or other suitable attachment techniques, are the integral components that form a core rectangular shaped bracket onto which the other metallic components of the motorized headrest and lumbar actuator system 20 are attached, including the two actuation mechanisms 25 and 26. This core bracket, which resembles a rectangle with two rounded corners, is illustrated in this back perspective view of FIG. 4.

Figure 5:
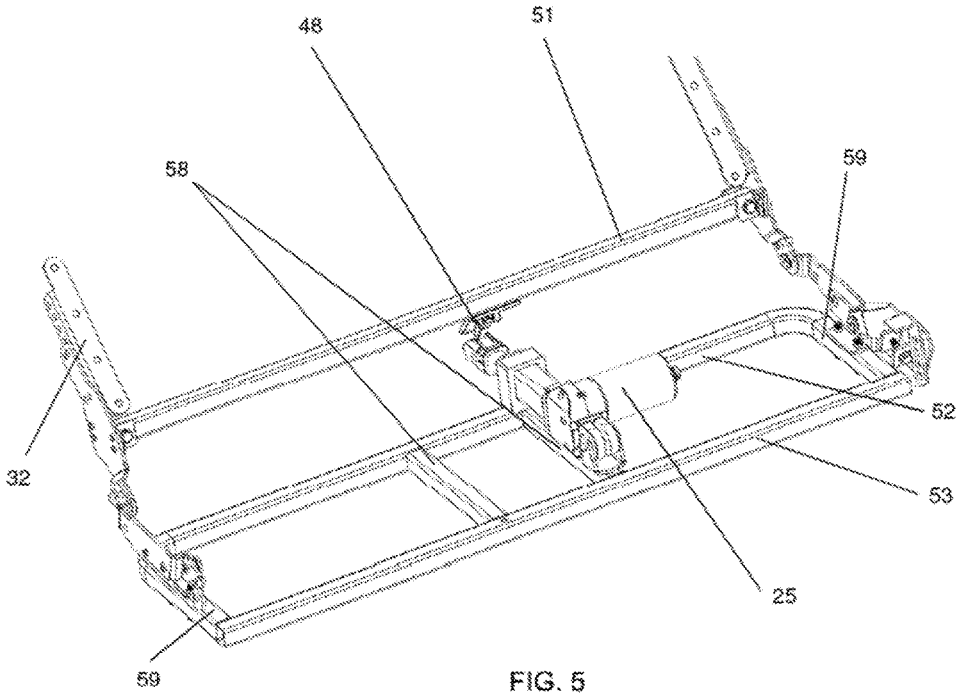
FIG. 5 is a front perspective view of the headrest actuator assembly of the headrest and lumbar support module of the present disclosure.
Figure 6:
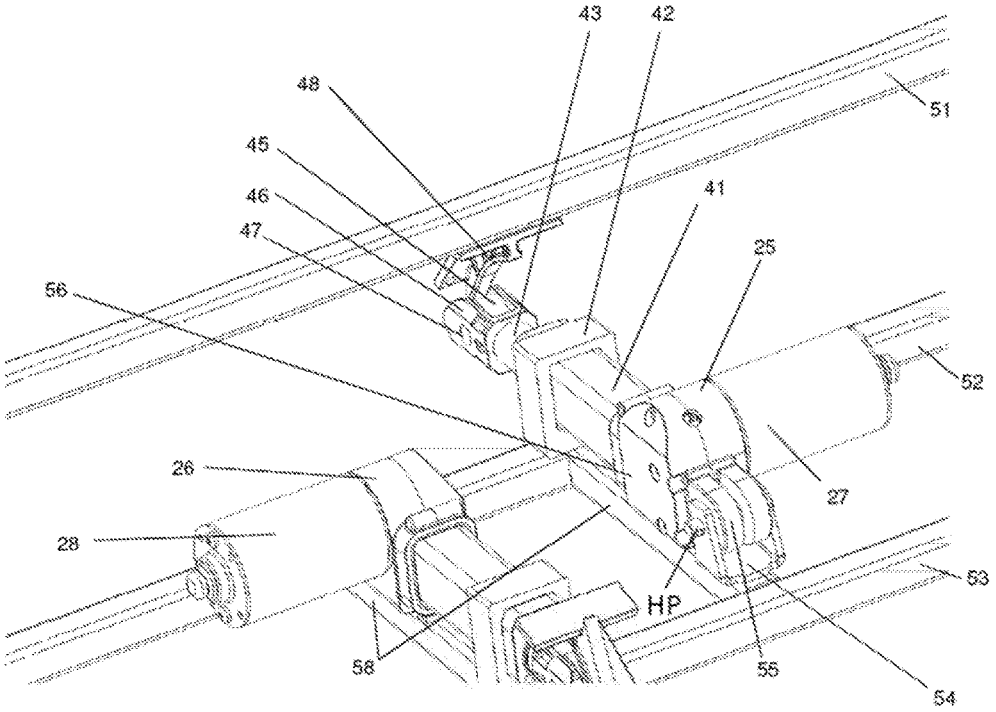
FIG. 6 is an enlarged front perspective view of the headrest actuator assembly and a portion of a lumbar actuator assembly of the headrest and lumbar support module of the present disclosure.
Figure 7:
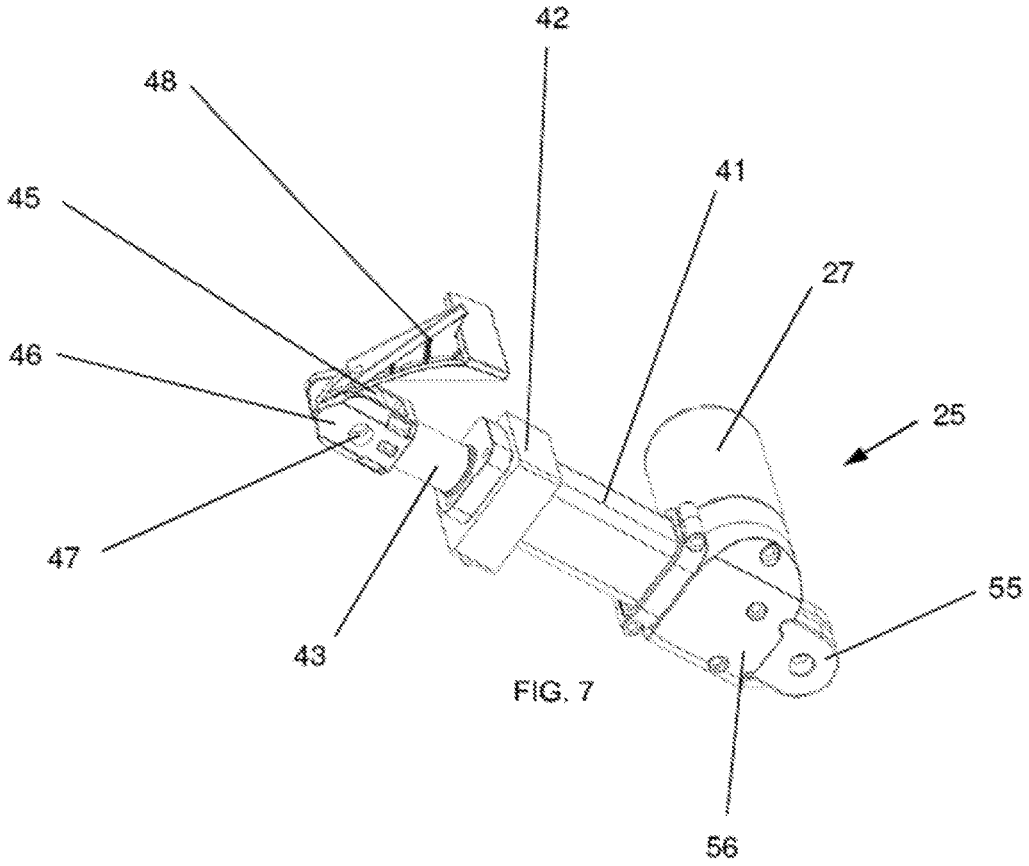
FIG. 7 is a left perspective view of an actuator and cam track member of the headrest actuator assembly of the headrest and lumbar support module of the present disclosure.

FIG. 5 is an enlarged view of the motorized headrest and lumbar actuation system 20 of FIG. 2 with some components omitted from this drawings for clarity and so as to provide better visibility of the other components. Illustrated is the headrest support mechanism 32 in its fully extended position and positioned at its maximum range of travel. Visible is the first actuation mechanism 25 which is the headrest actuation mechanism that is used to move the headrest support mechanism 32. The actuation mechanism 25 is shown in this drawing fully extended and at its maximum range of travel. The tip of this actuation mechanism 25 is connected to the headrest cross bar member 51 through a special interconnecting curvilinear track bracket 48 which will be described in greater detail, below. The second actuation mechanism 26 of FIG. 2 is omitted to better show the two middle cross bar members 58 which are two of the bar elements that connect the upper cross bar member 52 to the lower cross bar member 53. The two actuation mechanisms 25 and 26, with the item 25 omitted, are mounted onto these two middle cross bar members 58.

Also connecting the upper cross bar member 52 to the lower cross bar member 53 are the two side cross bar members 59. This core bracket which has a rectangular shape with two curved corners and it serves as the chassis which forms the base frame of the entire motorized headrest and lumbar actuation system 20 illustrated in its entirety in FIG. 2.

Turning to FIGS. 6-15, the interaction of the first actuation mechanism 25 with the curvilinear track bracket 48 secured to the upper cross bar member 51 (and thereby associated with the headrest support mechanism 32) will now be described. It will be appreciated that the composition of the second actuation mechanism 26 is the same or sufficiently similar to the first actuation mechanism 25, and the interaction of the second actuation mechanism 26 with the other curvilinear track bracket 48 secured to the lumbar cross bar member 54 (and thereby associated with the lumbar support mechanism 33) is similar to that of the first actuation mechanism 25 with the curvilinear track bracket 48 secured to the upper cross bar member 51, so detailed discussion lumbar actuation mechanism is omitted for the sake of brevity.

The first actuation mechanism 25 includes, as part of the headrest actuation mechanism, a receiver housing 41 of the actuation mechanism, a receiver collar 42 of the actuation mechanism, which serves to support the receiver housing 41 of the first actuation mechanism 25 on the upper cross bar member 52. The first actuation mechanism 25 further includes a piston arm 43 that is telescopingly mounted in the receiver housing 25. A first actuation motor 27 is provided on an actuator housing connector bracket 56. The actuator housing connector bracket 56 supports an actuator connector 55 that hingedly engages an actuator mounting bracket 54 secured to an associated one of the middle cross bar members 58. A hinge pin (HP) secures the actuator connector 55 to the mounting bracket 54.

The actuation motor 27 drives gearing (not shown) within the receiver housing 41 to selectively extend or retract the piston arm 43 in a known manner, such that detailed description of the architecture of the interior of the actuation mechanism 25 is omitted. A roller housing 46 is mounted, preferably by a threaded connecting region 49, to an engagement end of the piston arm 43, opposite from the end of the piston arm 43 that is entirely contained in the receiver housing 41.

The roller housing 46 rotatably supports a cam wheel, also referred to herein as a roller wheel 45, on a roller axle pin 47 that extends between two cam wheel shrouds WS1 and WS2 of the roller housing 46. The cam wheel shrouds WS1 and WS2 preferably have at least one dimension in a plane normal to an axis of rotation of the roller wheel 45 that is greater than a diameter of the roller wheel 45. The cam wheel shrouds WS1 and WS2 serve to isolate an interior of the roller wheel 45 and an exterior of the roller axle pin 47 from debris, such as sawdust or loose padding from the furniture article in which the motorized headrest and lumbar actuation system 20 is deployed, and also serve as boundaries or bumpers to maintain the roller wheel 45 in contact with the curvilinear track 61 of the curvilinear track bracket 48 by preventing lateral disengagement of the roller wheel 45 from the curvilinear track 61.

Figure 8:
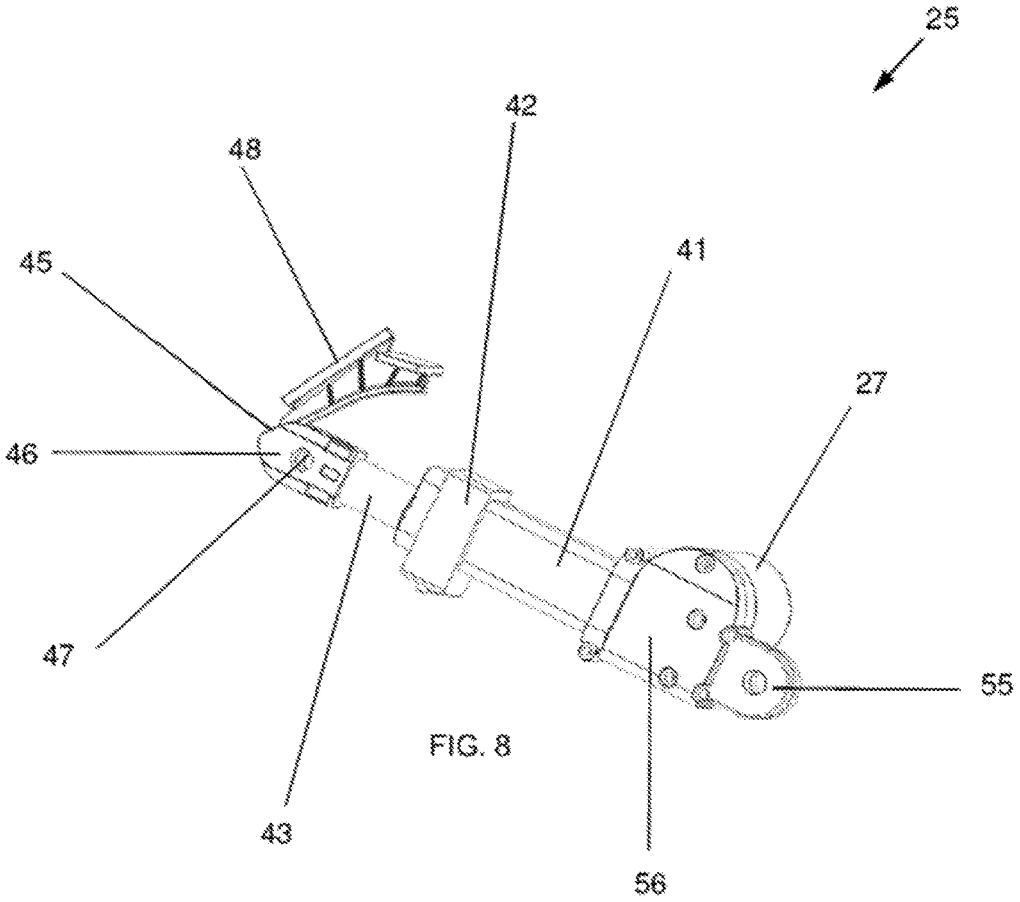
FIG. 8 is a left perspective view similar to FIG. 7 but from a different angle, of the actuator and curvilinear track member of the headrest actuator assembly of the headrest and lumbar support module of the present disclosure.
Figure 8A:
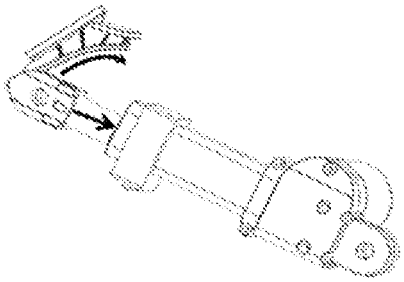
FIG. 8A is a left perspective view of the actuator and curvilinear track member of the headrest actuator assembly in the identical position to that of FIG. 8, annotated to illustrate the piston arm of the actuator of the headrest actuator assembly fully extended at its maximum travel point and the associated roller wheel of the actuator of the headrest actuator assembly at a first end of its travel along the curvilinear track member.
Figure 8B:
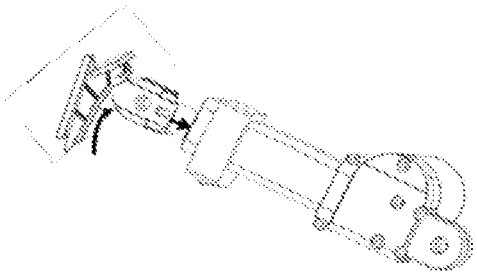
FIG. 8B is a left perspective view similar to FIG. 8A, but illustrating the piston arm of the actuator of the headrest actuator assembly fully retracted at its minimum travel point and the associated roller wheel at a second end of its travel along the curvilinear track member.
Figure 9:
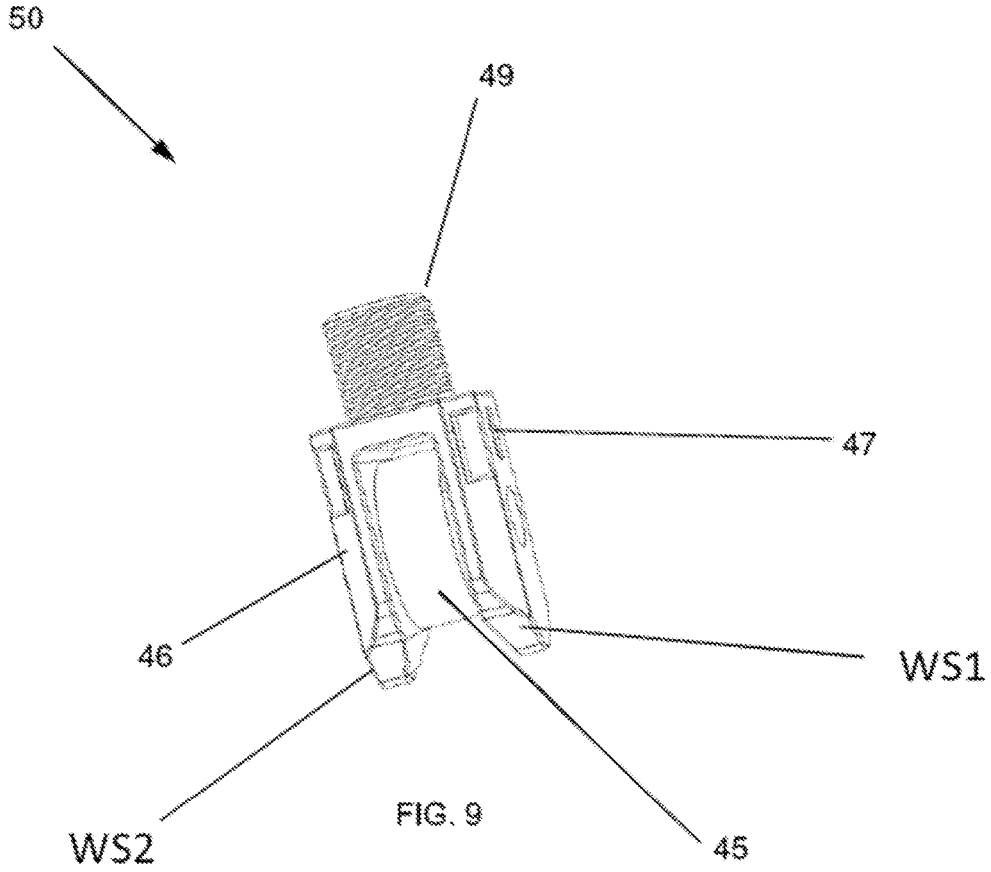
FIG. 9 is a perspective view of a wheel unit of the headrest actuator assembly of the headrest and lumbar support module of the present disclosure.
Figure 10:
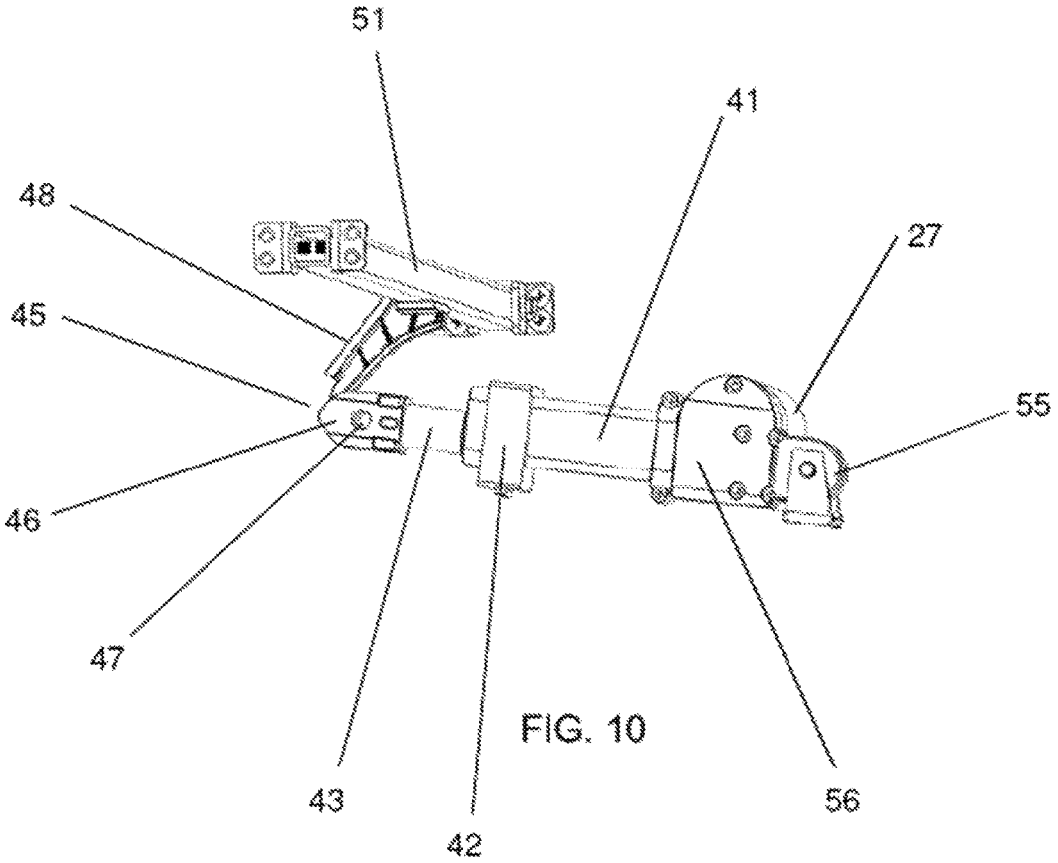
FIG. 10 is a left perspective view of the headrest actuator assembly with the cam track member mounted to a cross-bar that defines a portion of the actuatable headrest.
Figure 11:
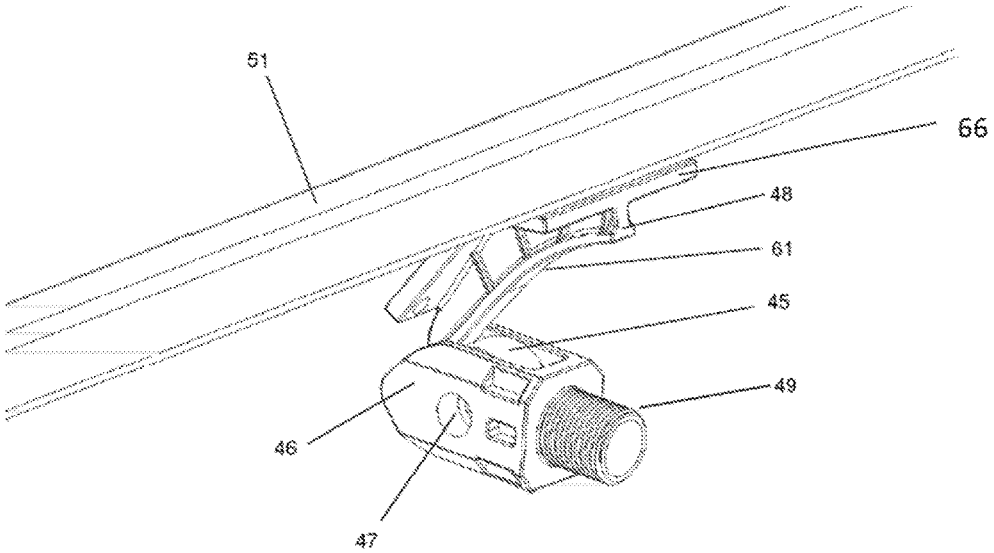
FIG. 11 is a left front perspective view of the wheel unit of the headrest actuator assembly positioned at a first extent of its travel relative to the cam track member, which can track member is mounted to the cross-bar defining a portion of the actuatable headrest.
Figure 12:
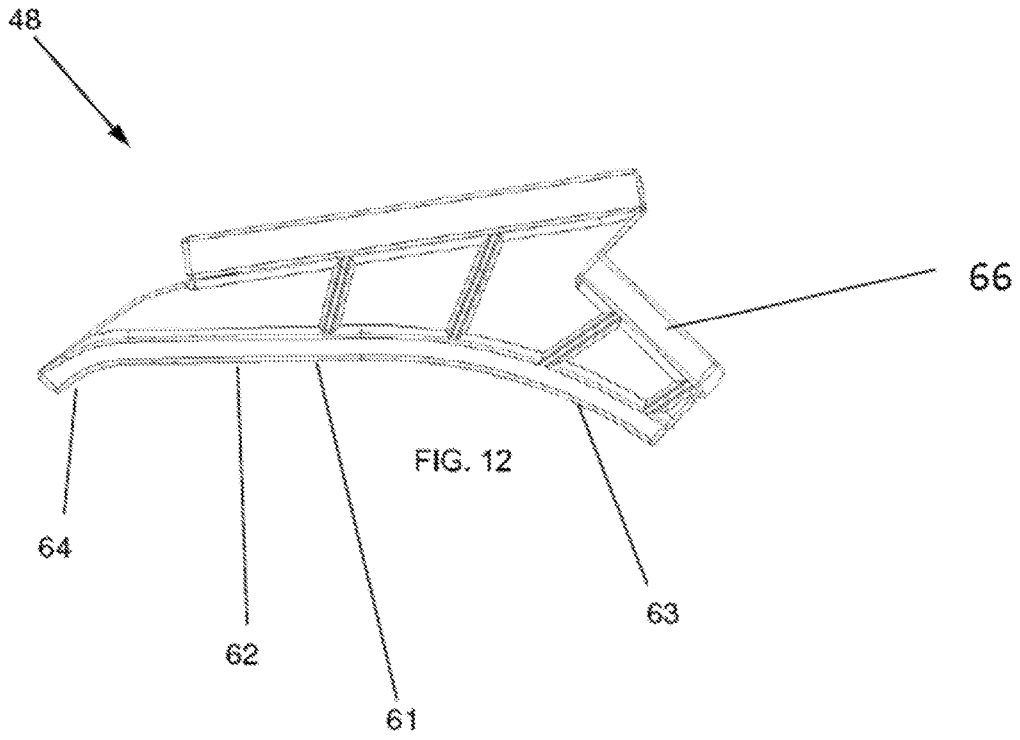
FIG. 12 is a side elevation view of the cam track member of the headrest actuator assembly.
Figure 13:
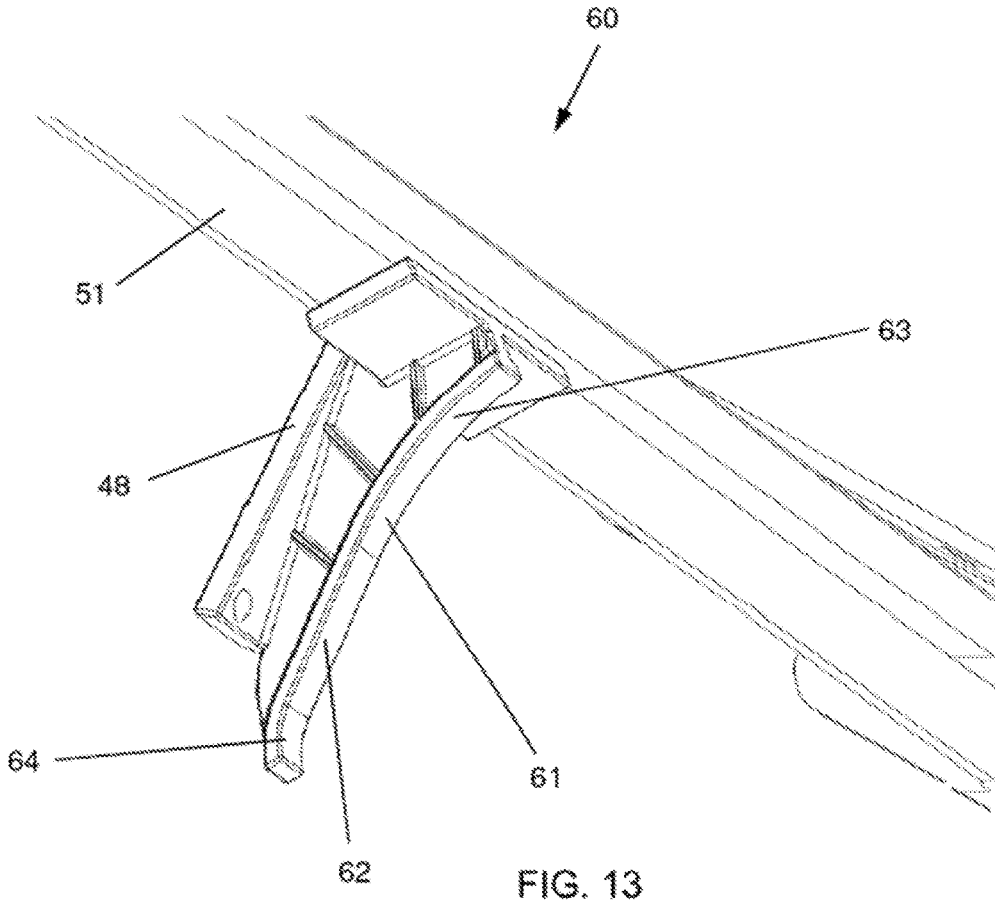
FIG. 13 is a front and bottom perspective view of the cam track member mounted to the cross-bar defining a portion of the actuatable headrest.
Figure 14:
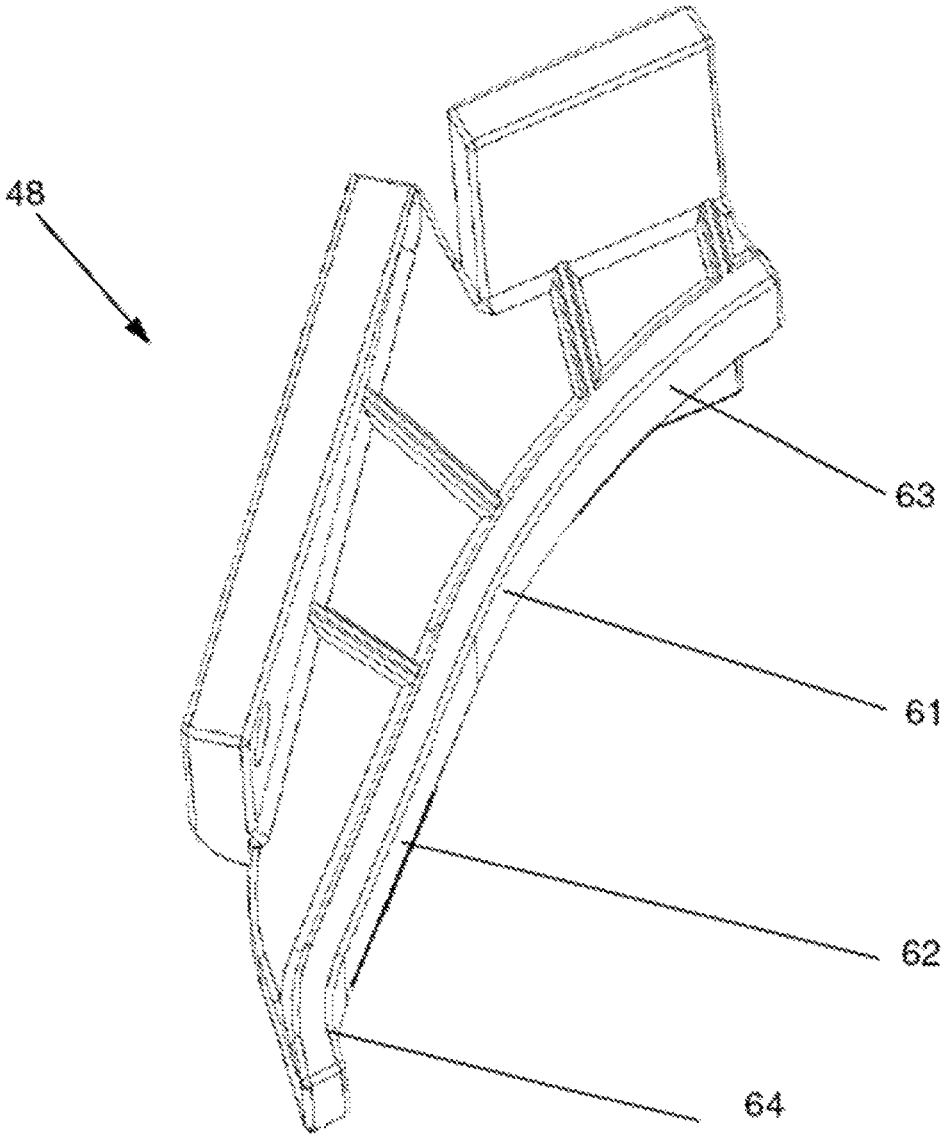
FIG. 14 is a perspective view of the cam track member of the headrest actuator assembly.
Figure 15:
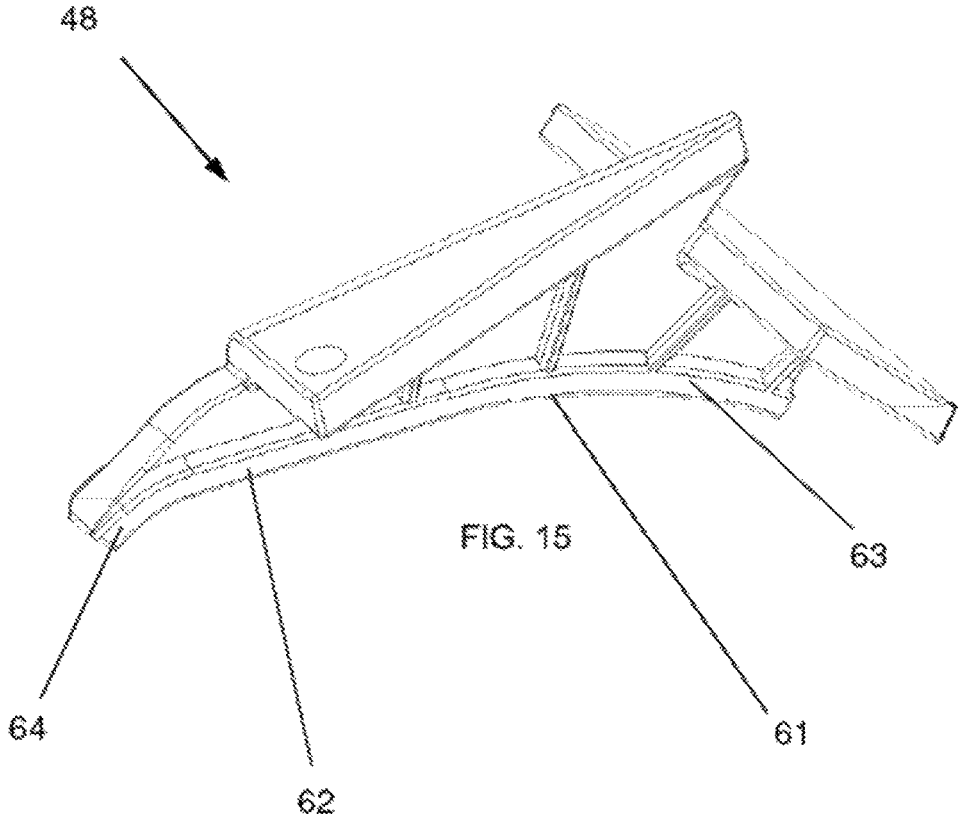
FIG. 15 is a top and rear perspective view of the cam track member of the headrest actuator assembly.

The curvilinear track bracket 48 includes at least a first mounting plate 66, to secure the curvilinear track bracket 48 to the headrest cross member 51. As illustrated in FIGS. 12-15, the curvilinear track 61 has a non-constant radius of curvature. Preferably, the curvilinear track 61 includes at least a linear section 62 and a curved section 63, the curved section 63 having a gradual curvature (i.e., a wide radius of curvature). At an end of the linear section 62 of the curvilinear track 62 opposite the curved section 63, the curvilinear track 61 is preferably provided with a curved end 64, having a relatively sharp curvature (i.e., a smaller radius of curvature than the curved section 63), thereby defining a first end stop that serves to prevent the roller wheel 45 of the first actuation mechanism 25 from losing contact with the curvilinear track 61 of the curvilinear track bracket 48. The curved section 63 of the curvilinear track 62 serves as the other end stop of the curvilinear track 61. FIGS. 8A and 8B illustrate the interaction of the linear actuator and the curvilinear track 61 at two extremes, with FIG. 8A illustrating the piston arm 43 of the first actuation mechanism 25 of the headrest actuator assembly fully extended at its maximum travel point and the associated roller wheel 45 of the actuator of the headrest actuator assembly at a first end of its travel along the curvilinear track 61, and FIG. 8B illustrating the piston of the first actuation mechanism 25 fully retracted at its minimum travel point and the associated roller wheel at a second end of its travel along the cam track member.

As the roller wheel 45 of the actuator of the headrest actuator assembly travels along the curvilinear track 61, the curvilinear track bracket 48 is urged up or down, imparting angular movement to the upper cross bar member 51 to which the curvilinear track bracket 48 is secured, thereby imparting angular movement to the headrest.

What is claimed is:

1. A motorized headrest assembly, comprising:

an actuator assembly including a receiver housing, a motor, a piston arm having a first end received in the receiver housing, and a roller housing disposed at an end of the piston arm opposite the end of the piston arm received in the receiver housing, the roller housing including a rotatably mounted roller wheel; and a curvilinear track bracket including a curvilinear track having a non-constant radius of curvature, the curvilinear track bracket secured to a portion of a headrest support mechanism and engaging the roller wheel.

2. The motorized headrest assembly of claim 1, the curvilinear track having a linearly-extending track region and a curved region.

3. The motorized headrest assembly of claim 2, the curvilinear track region further including a curved end region at an end of the linearly-extending track region opposite the curved region, the curved end region having a radius of curvature smaller than the curved region.

4. The motorized headrest assembly of claim 1, the actuator assembly and the curvilinear track bracket mounted sufficiently close to a center line of the headrest support mechanism to achieve angular actuation of the headrest support mechanism without one side of the headrest support mechanism lagging behind the other during angular movement thereof.

5. The motorized headrest assembly of claim 1, the roller housing including a first cam wheel shroud on a first side of the roller wheel and a second cam wheel shroud on a second side of the roller wheel.

6. The motorized headrest assembly of claim 1, each of the first and second cam wheel shrouds having at least one dimension in a plane normal to an axis of rotation of the roller wheel that is greater than a diameter of the roller wheel, the cam wheel shrouds thereby serving to maintain engagement between the roller wheel and the curvilinear track of the curvilinear track bracket.

7. The motorized headrest assembly of claim 1, in combination with a motorized lumbar assembly, the motorized lumbar assembly including a lumbar actuator assembly including a lumbar actuator receiver housing, a lumbar actuator motor, a lumbar actuator piston arm having a first end received in the lumbar actuator receiver housing, and a lumbar actuator roller housing disposed at an end of the piston arm opposite the end of the piston arm received in the receiver housing, the lumbar actuator roller housing including a rotatably mounted lumbar actuator roller wheel; and a second curvilinear track bracket including a second curvilinear track having a non-constant radius of curvature, the second curvilinear track bracket secured to a portion of a lumbar support mechanism and engaging the lumbar actuator roller wheel.

8. The motorized headrest assembly of claim 7, the lumbar actuator assembly and the second curvilinear track bracket mounted sufficiently close to a center line of the associated lumbar support mechanism to achieve angular actuation of the lumbar support mechanism without one side of the lumbar support mechanism assembly lagging behind the other during angular movement thereof.

9. The motorized headrest assembly of claim 8, and the actuator assembly and the curvilinear track bracket mounted sufficiently close to a center line of the headrest support mechanism to achieve angular actuation of the headrest support mechanism without one side of the headrest support mechanism lagging behind the other during angular movement thereof.

10. The motorized headrest assembly of claim 9, wherein the actuator assembly is offset from a centerline of the headrest support mechanism and the lumbar actuator assembly is offset from a centerline of the lumbar support mechanism.

11. The motorized headrest assembly of claim 1, in combination with a wooden frame of a back deck of a reclining furniture article.

* * * * *